US006692236B1

(12) United States Patent
Filippo et al.

(10) Patent No.: US 6,692,236 B1
(45) Date of Patent: Feb. 17, 2004

(54) TWO-STAGE COMPRESSOR WITH TORQUE REDUCING CRANKSHAFT

(75) Inventors: Dorin Filippo, Florence (IT); Dami Maurizio, Florence (IT)

(73) Assignee: Officine Mario Dorin S.p.A., Florence (IT)

( * ) Notice: Subject to any disclaimer, the term of this patent is extended or adjusted under 35 U.S.C. 154(b) by 109 days.

(21) Appl. No.: 10/030,495

(22) PCT Filed: Jun. 26, 2000

(86) PCT No.: PCT/IT00/00262

§ 371 (c)(1),
(2), (4) Date: Dec. 31, 2001

(87) PCT Pub. No.: WO01/02725

PCT Pub. Date: Jan. 11, 2001

(30) Foreign Application Priority Data

Jul. 2, 1999 (IT) ..... FI99A0154

(51) Int. Cl.[7] ..... F04B 25/00
(52) U.S. Cl. ..... 417/254; 417/521; 92/73

(58) Field of Search ..... 92/73, 147; 417/521, 417/533, 254, 265

(56) References Cited

U.S. PATENT DOCUMENTS

| | | | | |
|---|---|---|---|---|
| 1,478,469 A | * | 12/1923 | Carver | 92/147 |
| 1,905,747 A | | 4/1933 | Peters | |
| 2,405,475 A | | 8/1946 | Voreaux | |
| 5,044,333 A | | 9/1991 | Fuchigami et al. | |

FOREIGN PATENT DOCUMENTS

| | | |
|---|---|---|
| DE | 571 940 | 3/1933 |
| FR | 1 113 243 | 3/1956 |
| FR | 2 376 946 | 8/1978 |

* cited by examiner

*Primary Examiner*—Edward K. Look
*Assistant Examiner*—Michael Leslie
(74) *Attorney, Agent, or Firm*—McGlew and Tuttle, P.C.

(57) ABSTRACT

The two cylinder and piston systems (1, 3), operating in series, are driven by a crankshaft, with a minimum or even zero phase difference.

4 Claims, 3 Drawing Sheets

TWO-STAGE COMPRESSOR WITH TORQUE REDUCING CRANKSHAFT

For the operation of two-stage compressors, with at least one cylinder and piston unit for preliminary compression and with a second cylinder and piston unit of smaller capacity for the second stage of compression, and similar machines, relatively very large peaks of torque occur during the cycle, making it necessary to have a high installed power (particularly with an electric motor) to ensure the regular operation of the machine. At the present time, use has been made of compressors having a large number of cylinder and piston systems to limit the peaks of torque (and of power), which entails high costs and large overall dimensions, as well as limited efficiency and difficult maintenance.

The object of the invention is to provide a simple machine, with a limited number of cylinder and piston systems operating in series (in practice, only two cylinder and piston systems operating in series), with the consequent advantages.

These and other objects and advantages will be made clear by the following text.

To achieve the objects indicated above, the invention relates to a machine such as a compressor of the two-stage type, with a pair of cylinder and piston systems operating in series and driven by a crankshaft, in which the two pistons are driven with a minimum phase difference, to reduce the peaks of torque.

Preferably, the two pistons are driven with a zero phase difference, so that the crankshaft can rotate equally well in one direction or in the opposite direction.

The invention also relates to a crankshaft for compressors and other equivalent machines, in which two cranks are positioned with a minimum or even a zero phase difference. Said shaft is to be appropriately balanced by the use of suitable counterweights.

The invention will be more clearly understood from the description and the attached drawing, which shows a practical, non-restrictive example of the invention. In the drawing:

FIG. 3 shows an absorption diagram of a two-stage compressor of the conventional type; while

Figure 1:
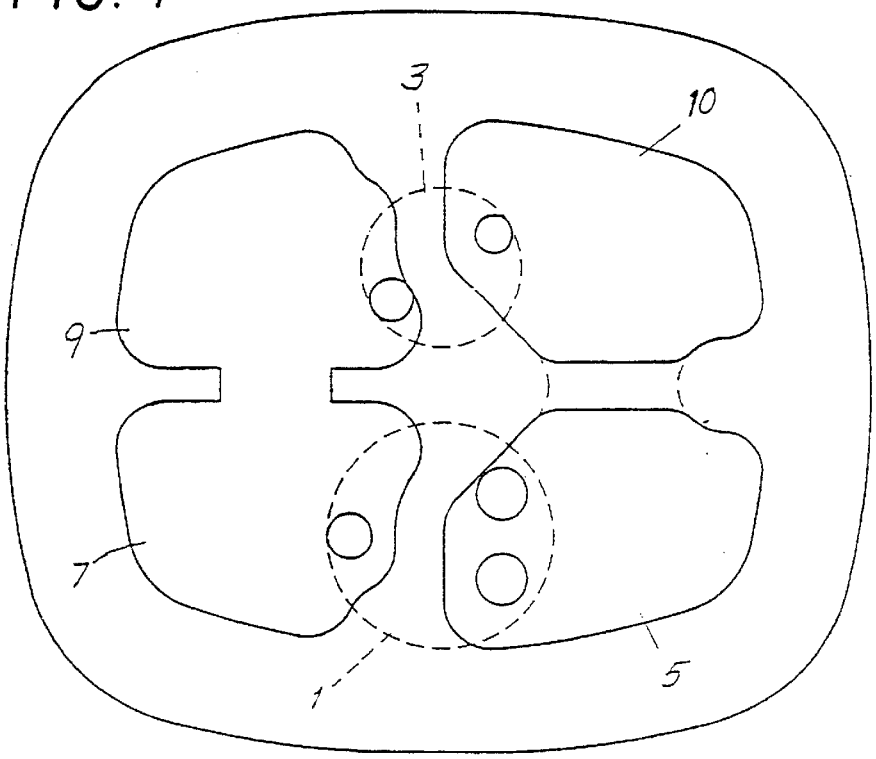
FIG. 1 shows a schematic view of the cylinder plane of a two-stage compressor according to the invention.

FIG. 1 shows in a general way a diagram of a two-stage compressor, in which the number 1 indicates the cylinder of the first stage and 3 indicates the cylinder of the second stage. The intake chamber of the cylinder and piston system of the first stage is indicated by 5 and the compression chamber of said first stage is indicated by 7; this chamber 7 communicates with the intake chamber 9 of the second stage, the final compression chamber of the second stage being indicated by 10.

The pressure inside the crankcase and therefore under the pistons is kept equal to that of the chambers 7 and 9, since the crankcase itself communicates with the chamber 9.

The force that generates the torque is determined by the pressure difference between the upper and the lower surfaces of the pistons of both the first and the second stage. In the case of the first stage, this difference is negative (the pressure on the top of the piston is lower than that on the bottom) during the first part of the compression phase.

Figure 3:
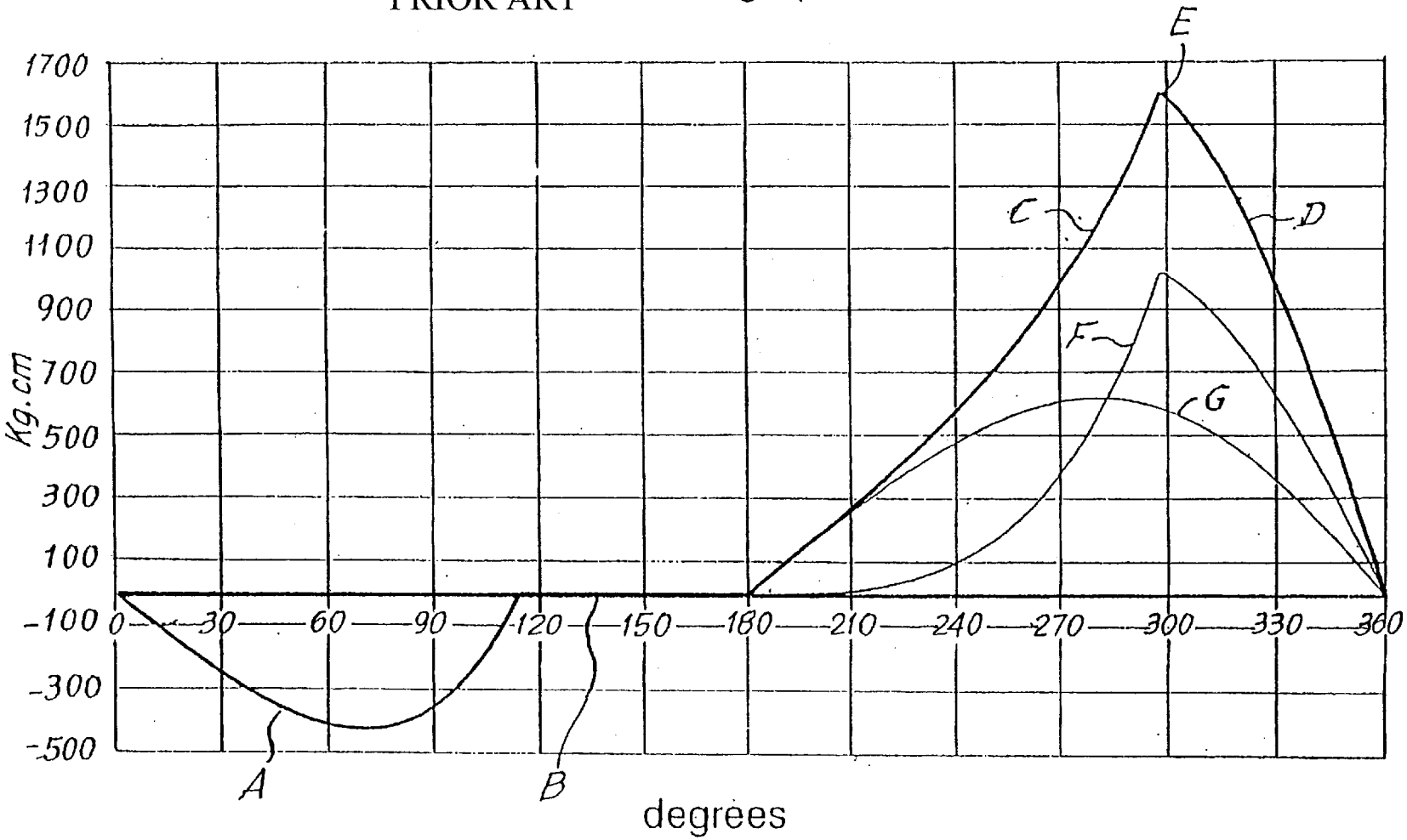
FIG. 3 PRIOR ART

In a conventional compressor of this type, the two cylinder and piston systems 1, 3 are designed to operate in counter-phase and therefore with a crankshaft with a phase difference of 180° between its two crankpins. In a known arrangement of this kind, therefore, the variation of the diagram of the torque required from the motor for driving the crankshaft is illustrated in the graph in FIG. 3, where the degrees of the cycle of rotation of the shaft are shown on the horizontal axis and the torque in kgxcm is shown on the vertical axis; in the said graph in FIG. 3, the curve A indicates the absorption due to the compression torque of the first stage for obtaining the intermediate pressure of the fluid. The straight section B parallel to the horizontal axis corresponds to the opening of the compression valve of the first stage. The second part of the cycle, represented by the curves C and D and by the cusp E, shows the overall variation in said second stage which corresponds to the sum of the torques due to the compression of the second stage, indicated by the line F, and to the intake of the first stage which is indicated by G; the intake of the second stage does essentially not require any torque, because of the equivalence between the two opposing forces acting on the piston. An examination of this graph in FIG. 3 shows clearly that a relatively very high peak of torque E appears in the graph which is illustrated.

Figure 2:
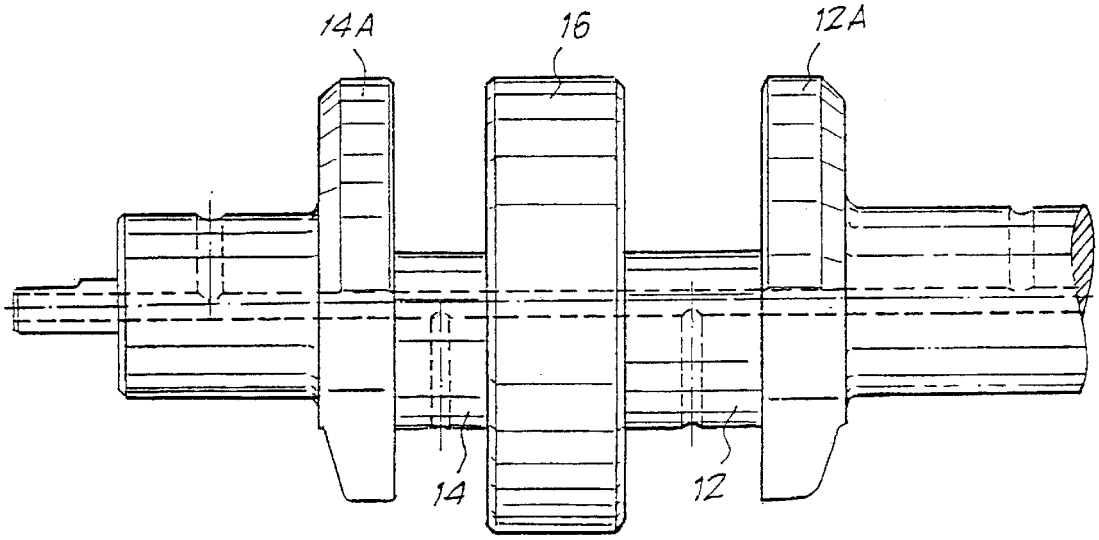
FIG. 2 shows in isolation the crankshaft of a compressor made according to the invention.
Figure 4:
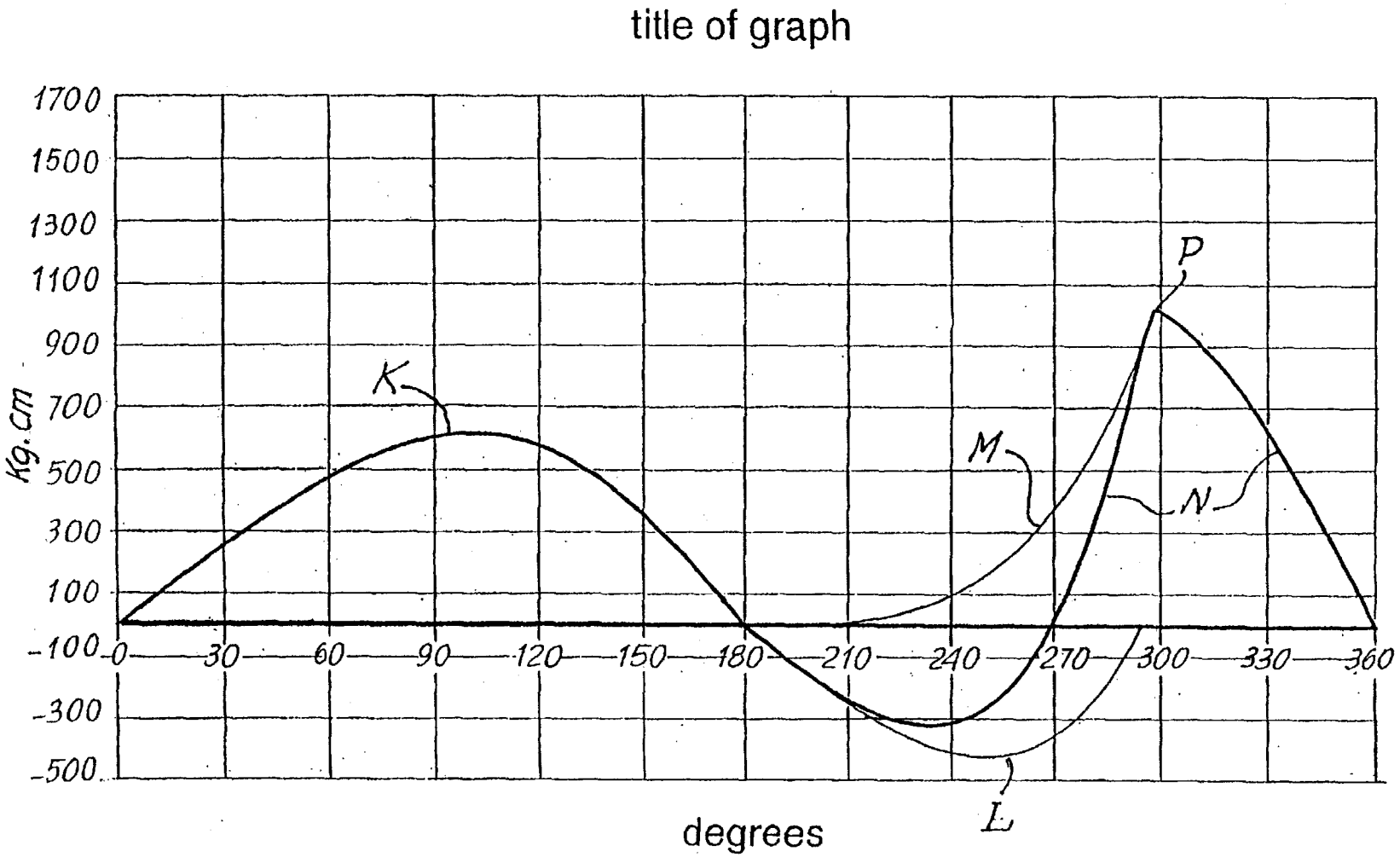
FIG. 4 shows an absorption diagram obtained with the device according to the invention.

According to the invention, the machine in question is provided with a crankshaft of the type illustrated in FIG. 2, in which the two crankpins 12 and 14 are exactly in phase with each other and are suitably balanced by counterweights such as those indicated by 12A and 14A, in addition to the flywheel 16 in an intermediate position between the two crankpins 12 and 14. With this driving shaft the two cylinder and piston systems are exactly in phase; it has been found that the graph of the torque present in a situation of this kind is that shown in FIG. 4, in which the curve K relates to the intake of the first stage, the curve L relates to the compression in the first stage, and the curve M relates to the compression of the second stage, while the intake of the second stage is practically free of force and consequently of torque, owing to the compensating effect of the pressures acting in opposite directions on the piston. The sum of the torques is therefore that indicated by the curve N, with a peak P whose size is much smaller with respect to that found at E in the conventional solution whose diagram is shown in FIG. 3.

To obtain an essentially balanced system, appropriate counterweights such as those indicated by 12A and 14A will be provided, and a suitable flywheel 16 will be provided between the two crankpins 12 and 14.

The aforementioned advantages are obtained with this arrangement.

It should be understood that the drawing shows only an example provided solely as a practical demonstration of the invention, said invention being variable in its forms and arrangements without thereby departing from the scope of the guiding principle of the invention. The presence of any reference numbers in the attached claims has the purpose of facilitating the reading of the claims with reference to the description and to the drawing, and does not limit the scope of protection represented by the claims.

What is claimed is:

1. A two-stage compressor, comprising:

a first stage piston;

a second stage piston;

a block forming a first stage cylinder, cooperating with said first stage piston to form a first stage cylinder and piston system and a block forming a second stage cylinder, cooperating with said second stage piston to form a second stage cylinder and piston system;

a case defining a closed volume communicating with a space under said first stage piston and under said second stage piston;

a crankshaft with two crankpins that drives said first stage piston and said second stage piston with essentially concordant phases;

a first intake chamber and a first compression chamber associated with said first stage cylinder and piston system;

a second intake chamber and a second compression chamber associated with said second stage cylinder and piston system, said first compression chamber and said second intake chamber communicating with each other and with said closed volume formed in said case.

2. A compressor according to claim 1, wherein said two crank pins of said crankshaft are perfectly in phase with each other.

3. A two-stage compressor, comprising:

a first stage piston;

a second stage piston;

a block forming a first stage cylinder, cooperating with said first stage piston to form a first stage cylinder and piston system and a block forming a second stage cylinder, cooperating with said second stage piston to form a second stage cylinder and piston system;

a crankcase defining a closed volume communicating with a space under said first stage piston and under said second stage piston;

a crankshaft with two crankpins that drives said first stage piston and said second stage piston with essentially concordant phases and with a common single direction working stroke;

a first intake chamber and a first compression chamber associated with said first stage cylinder and piston system;

a second intake chamber and a second compression chamber associated with said second stage cylinder and piston system, said first compression chamber and said second intake chamber communicating with each other and with said closed volume formed in said case.

4. A compressor according to claim 3, wherein said two crank pins of said crankshaft are perfectly in phase with each other.

* * * * *